US007952342B2

(12) United States Patent
Satoh

(10) Patent No.: US 7,952,342 B2
(45) Date of Patent: May 31, 2011

(54) CONSTANT CURRENT SOURCE APPARATUS

(75) Inventor: Hiroyuki Satoh, Tokyo (JP)

(73) Assignee: Advantest Corporation, Tokyo (JP)

( * ) Notice: Subject to any disclaimer, the term of this patent is extended or adjusted under 35 U.S.C. 154(b) by 343 days.

(21) Appl. No.: 11/873,425

(22) Filed: Oct. 17, 2007

(65) Prior Publication Data

US 2009/0284236 A1 Nov. 19, 2009

(51) Int. Cl.
*G05F 1/46* (2006.01)
*G05F 1/56* (2006.01)
*G05F 1/563* (2006.01)

(52) U.S. Cl. ..... 323/317; 323/314

(58) Field of Classification Search ..... 323/311–315, 323/317

See application file for complete search history.

(56) References Cited

U.S. PATENT DOCUMENTS 4,004,158 A * 1/1977 Morgan ..... 327/87
4,540,953 A * 9/1985 Togari et al. ..... 330/284
5,796,276 A * 8/1998 Phillips et al. ..... 327/108
5,798,723 A * 8/1998 Fong ..... 341/136
6,201,380 B1 * 3/2001 Tsujino et al. ..... 323/313
6,597,240 B1 * 7/2003 Walburger et al. ..... 330/10

* cited by examiner

*Primary Examiner* — Gary L Laxton
*Assistant Examiner* — Nusrat J Quddus
(74) *Attorney, Agent, or Firm* — Chen Yoshimura LLP

(57) ABSTRACT

A constant current source apparatus is provided that includes a complementary switching section that selectively outputs a reference voltage or a driving voltage according to a control signal and a constant current source circuit that causes a constant current determined by the reference voltage to flow to a load in a case where the reference voltage is received from the complementary switching section and cuts off the current flowing to the load in a case where the driving voltage is received from the complementary switching section. The complementary switching section includes a first FET in which one of either a source or a drain is connected to the driving voltage, the other source or drain is connected to an output end of the complementary switching section, and a gate receives the voltage according to the control signal and a second FET that switches to an opposite polarity of the first FET in which one of either a source or a drain is connected to the reference voltage, the other source or drain is connected to the output end of the complementary switching section, and a gate receives the voltage according to the control signal.

16 Claims, 2 Drawing Sheets

CONSTANT CURRENT SOURCE APPARATUS

BACKGROUND

1. Technical Field

The present invention relates to a constant current source apparatus and, more particularly, the present invention relates to a constant current source apparatus that turns a current flowing to a load on or off.

2. Related Art

A constant current source apparatus such as a current mirror circuit or the like is known. The constant current source apparatus can cause a constant current to flow to a load regardless of variance of impedance of the load.

A control apparatus controlling operation of the constant current source apparatus must stop a supply of bias voltage to the constant current source apparatus in a case where the constant current source apparatus is turned off. Accordingly, the control apparatus is unable to turn the constant current source apparatus on or off by supplying a signal different than an operating voltage (a logic signal, for example) to the constant current source apparatus.

SUMMARY

Therefore, it is an object of an aspect of the present invention to provide a constant current source apparatus, which is capable of overcoming the above drawbacks accompanying the related art. The above and other objects can be achieved by combinations described in the independent claims. The dependent claims define further advantageous and exemplary combinations of the present invention.

According to a first aspect related to the innovations herein, one exemplary apparatus may include a constant current source apparatus. The constant current source apparatus includes a complementary switching section that selectively outputs a reference voltage or a driving voltage according to a control signal and a constant current source circuit that causes a constant current determined by the reference voltage to flow to a load in a case where the reference voltage is received from the complementary switching section and cuts off the current flowing to the load in a case where the driving voltage is received from the complementary switching section.

The summary clause does not necessarily describe all necessary features of the embodiments of the present invention. The present invention may also be a sub-combination of the features described above. The above and other features and advantages of the present invention will become more apparent from the following description of the embodiments taken in conjunction with the accompanying drawings.

DESCRIPTION OF EXEMPLARY EMBODIMENTS

Hereinafter, an embodiment of the present invention will be described. The embodiment does not limit the invention according to the claims, and all the combinations of the features described in the embodiment are not necessarily essential to means provided by aspects of the invention.

Figure 1:
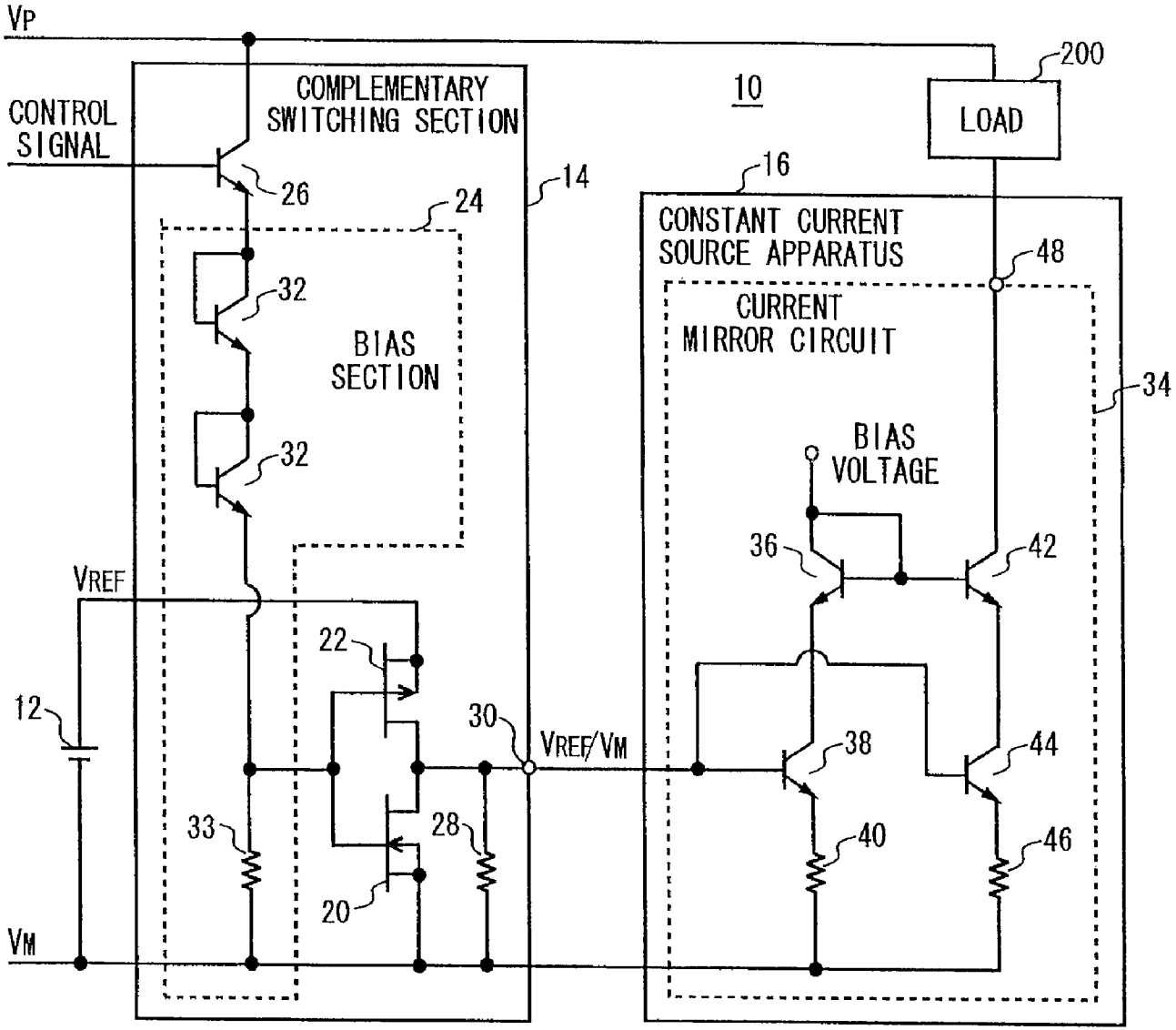
FIG. 1 shows a configuration of a negative FET 20 together with a load 200 according to an embodiment of the present invention.

FIG. 1 shows a configuration of a constant current source apparatus 10 together with a load 200 according to an embodiment of the present invention. The constant current source apparatus 10 causes a constant current to flow to the load 200 in a case where a control signal indicating "on" is supplied from an external section. Furthermore, the constant current source apparatus 10 cuts off the current flowing to the load 200 in a case where a control signal indicating "off" is supplied from the external section. In other words, the constant current source apparatus 10 sets the current flowing to the load 200 to be zero in a case where the control signal indicating "off" is supplied from the external section The constant current source apparatus 10 is provided with a reference voltage generation section 12, a complementary switching section 14, and a constant current source circuit 16. The reference voltage generation section 12 generates a reference voltage $V_{REF}$. For example, the reference voltage generation section 12 may be a bandgap reference circuit that generates the reference voltage $V_{REF}$.

For example, the bandgap reference circuit uses a diode supplied with a forward bias to generate the reference voltage $V_{REF}$. The bandgap reference circuit negates forward voltage variance according to a negative temperature coefficient of the diode by generating a voltage having a positive temperature coefficient. Accordingly, the bandgap reference circuit can output the constant reference voltage $V_{REF}$ in changing temperatures.

The complementary switching section 14 selectively outputs the reference voltage $V_{REF}$ or a driving voltage (in the present embodiment, a negative driving voltage $V_M$) according to a control signal. The driving voltage may be a positive driving voltage $V_P$ or a ground potential instead of the negative driving voltage $V_M$.

Specifically, the complementary switching section 14 outputs the reference voltage $V_{REF}$ in a case where a control signal indicating "on" is supplied from an external section. Furthermore, the complementary switching section 14 outputs the negative driving voltage $V_M$ in a case where a control signal indicating "off" is supplied from the external section.

In the present embodiment, the complementary switching section 14 includes a negative FET 20, a positive FET 22, a bias section 24, a switching circuit 26, and a protection resistor 28. One of either a source or a drain of the negative FET 20 is connected to the negative driving voltage $V_M$ and the other source or drain is connected to an output end 30 of the complementary switching section 14. The negative FET 20 receives voltage at a gate according to the control signal.

The negative FET 20 may be an n-type MOSFET, for example. In such a case, the source of the negative FET 20 is connected to the negative driving voltage $V_M$ and the drain is connected to the output end 30.

One of either a source or a drain of the positive FET 22 is connected to the reference voltage $V_{REF}$ and the other source or drain is connected to the output end 30 of the complementary switching section 14. The positive FET 22 receives voltage at a gate according to the control signal and switches polarity with the negative FET 20.

For example, the positive FET 22 may be a p-type MOSFET. In such a case, the source of the positive FET 22 is connected to the reference voltage $V_{REF}$ and the drain is connected to the output end 30.

The bias section 24 supplies to the gate of the negative FET 20 and the positive FET 22 a first voltage that turns on the negative FET 20 and turns off the positive FET 22 (a voltage sufficiently higher than the negative driving voltage $V_M$) or a second voltage that turns off the negative FET 20 and turns on the positive FET 22 (a voltage sufficiently lower than the reference voltage $V_{REF}$). For example, the bias section 24 may include one or more transistors 32 having a diode-connection and a bias input resistor 33. The one or more transistors 32 are connected serially between the positive driving voltage $V_P$ and the gate of the negative FET 20 and the positive FET 22. The bias input resistor 33 is connected between the gate of the negative FET 20 and the positive FET 22 and the negative driving voltage $V_M$. The bias section 24 having such a configuration can supply a first voltage and a second voltage to the gate of the negative FET 20 and the positive FET 22.

The switching circuit 26, according to the control signal, switches between supplying the first voltage to the gate of the negative FET 20 and the positive FET 22 and supplying the second voltage to the gate of the negative FET 20 and the positive FET 22. For example, the switching circuit 26 may be an npn transistor connected serially in the bias section 24 between the positive driving voltage VP and the gate of the negative FET 20 and the positive FET 22. In a case where a control signal indicating "on" is supplied from the external section, the switching circuit 26 causes the current flowing to the bias input resistor 33 to be sufficiently small, so that the second voltage (a voltage sufficiently lower than the reference voltage $V_{REF}$) is provided to the gate of the negative FET 20 and the positive FET 22. Furthermore, in a case where a control signal indicating "off" is supplied from the external section, the switching circuit 26 causes the current flowing to the bias input resistor 33 to be sufficiently large, so that the first voltage (a voltage sufficiently higher than the negative driving voltage $V_M$) is provided to the gate of the negative FET 20 and the positive FET 22.

The protection resistor 28 is connected between the output end 30 of the complementary switching section 14 and the negative driving voltage $V_M$. Even in a case where both the negative FET 20 and the positive FET 22 are momentarily turned off, the protection resistor 28 described above can set the negative driving voltage $V_M$ without making the potential of the output end 30 inconsistent.

In a case where a control signal indicating "on" is supplied from the external section, the complementary switching section 14 configured as described above turns on the positive FET 22 and turns off the negative FET 20. Furthermore, in a case where a control signal indicating "off" is supplied from the external section, the complementary switching section 14 turns on the negative FET 20 and turns off the positive FET 22. Accordingly, the complementary switching section 14 can selectively output the reference voltage $V_{REF}$ or the negative driving voltage $V_M$ from the output end 30.

The constant current source circuit 16 receives the reference voltage $V_{REF}$ or the negative driving voltage $V_M$ output from the complementary switching section 14. In a case where the reference voltage $V_{REF}$ is received from the complementary switching section 14, the constant current source circuit 16 causes a current determined by the reference voltage $V_{REF}$ to flow to the load 200. In a case where the negative driving voltage $V_M$ is received from the complementary switching section 14, the constant current source circuit 16 cuts off the flow of current to the load 200.

For example, the constant current source circuit 16 may include a current mirror circuit 34. The current mirror circuit 34 may include, for example, a control transistor 36, a first bias transistor 38, a first reference resistor 40, a current source transistor 42, a second bias transistor 44, and a second reference resistor 46.

A base-collector junction of the control transistor 36 is a short-circuit. In other words, the control transistor 36 is a diode connection. Furthermore, a collector of the control transistor 36 is connected to a prescribed bias voltage.

A collector of the first bias transistor 38 is connected to an emitter of the control transistor 36 and an emitter of the first bias transistor 38 is connected to the negative driving voltage $V_M$ via the first reference resistor 40. The first reference resistor 40 has a predetermined resistance value. Furthermore, a base of the first bias transistor 38 is supplied with the reference voltage $V_{REF}$ or the negative driving voltage $V_M$ from the complementary switching section 14.

In other words, the first bias transistor 38 is connected between the emitter of the control transistor 36 and the negative driving voltage $V_M$. In a case where the reference voltage $V_{REF}$ is received from the complementary switching section 14, the first bias transistor 38 generates a bias determined by the reference voltage $V_{REF}$. Furthermore, in a case where the negative driving voltage $V_M$ is received from the complementary switching section 14, the first bias transistor 38 becomes open.

The current source transistor 42 may be a transistor having generally the same type of characteristics as the control transistor 36. A base of the current source transistor 42 is connected to the base of the control transistor 36. A collector of the current source transistor 42 is connected to the load 200 via the load connection end 48. A collector-emitter junction of the current source transistor 42 described above is serially connected to the load 200, so that the current flowing to the load 200 flows to the collector-emitter junction.

A collector of the second bias transistor 44 is connected to the emitter of the current source transistor 42 and an emitter of the second bias transistor 44 is connected to the negative driving voltage $V_M$ via the second reference resistor 46. The second reference resistor 46 includes a resistance value proportional to the first reference resistor 40. For example, the second reference resistor 46 may have the same resistance value as the first reference resistor 40. Furthermore, a base of the second bias transistor 44 is supplied with the reference voltage $V_{REF}$ or the negative driving voltage $V_M$ from the complementary switching section 14.

In other words, the second bias transistor 44 is connected between the emitter of the current source transistor 42 and the negative driving voltage $V_M$. In a case where the reference voltage $V_{REF}$ is received from the complementary switching section 14, the second bias transistor 44 generates a bias determined by the reference voltage $V_{REF}$. Furthermore, in a case where the negative driving voltage $V_M$ is received from the complementary switching section 14, the second bias transistor 44 becomes open.

In the current mirror circuit 34 configured as described above, in a case where the reference voltage $V_{REF}$ is received from the complementary switching section 14, the collector-emitter junctions of the first bias transistor 38 and the second bias transistor 44 become a predetermined bias voltage. Therefore, a predetermined fixed collector current flows to the control transistor 36. Then, because the control transistor 36 and the current source transistor 42 function as current mirrors, a collector current proportional to the collector current flowing to the control transistor 36 flows to the current source transistor 42. For example, a collector current that is the same as the collector current flowing to the control transistor 36 flows to the current source transistor 42.

Furthermore, in the current mirror circuit 34 described above, in a case where the negative driving voltage $V_M$ is received from the complementary switching section 14, the collector-emitter junctions of the first bias transistor 38 and the second bias transistor 44 become open. Therefore, a collector current of the control transistor 36 becomes zero, which causes the collector current of the current source transistor 42 to also become zero.

In the manner described above, the constant current source apparatus 10 can cause a constant current to flow to the load 200 because the complementary switching section 14 outputs the reference voltage $V_{REF}$ in a case where a control signal indicating "on" is supplied from the external section. Furthermore, the constant current source apparatus 10 can cut off the flow of current to the load 200 because the complementary switching section 14 outputs the negative driving $V_M$ in a case where a control signal indicating "off" is supplied from the external section. Accordingly, through the constant current source apparatus 10 configured as described above, a constant current flowing to the load 200 can be turned on or off by receiving logic signals having different operating voltages.

Figure 2:
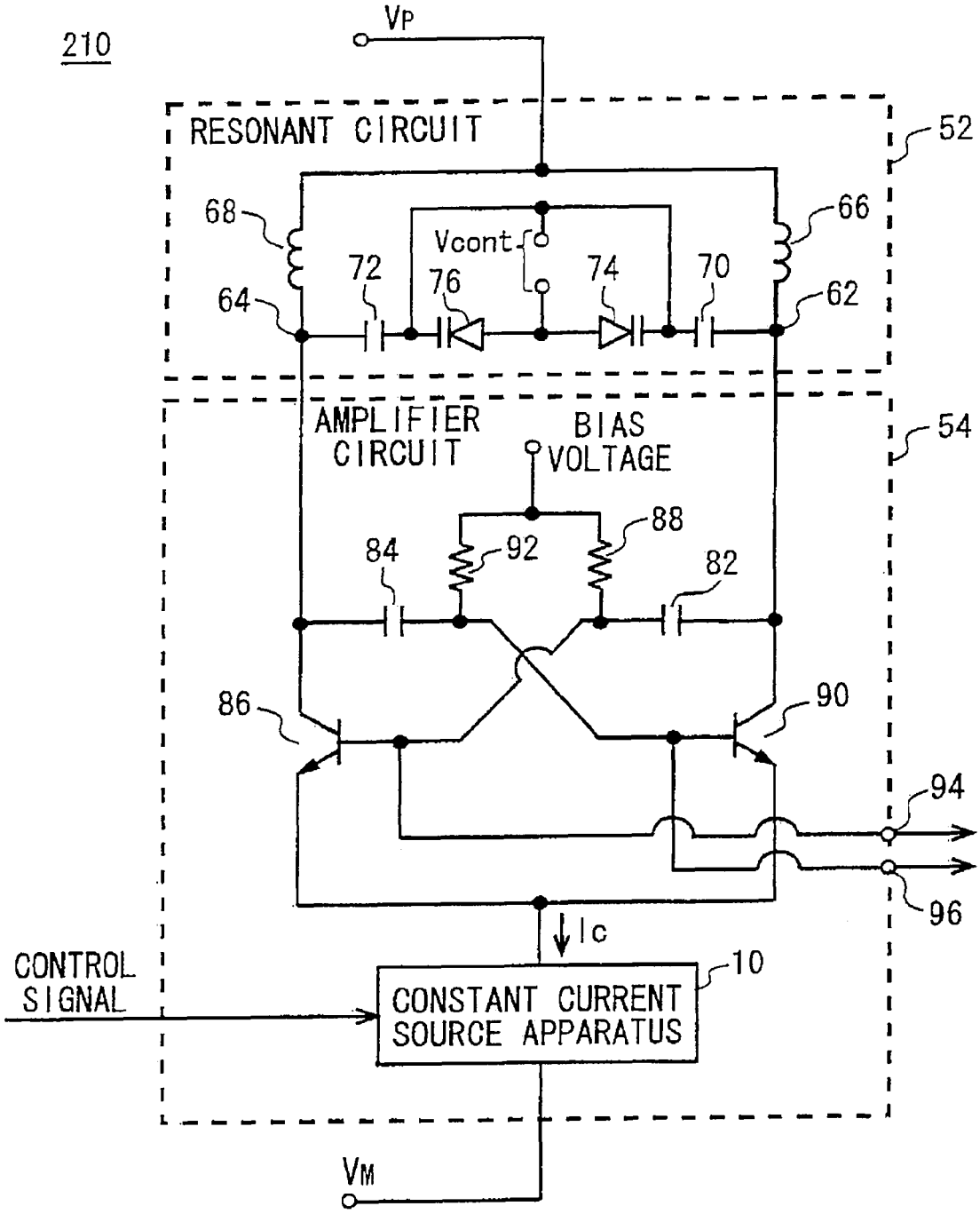
FIG. 2 shows a circuit configuration of a voltage control oscillator 210 according to the present embodiment.

FIG. 2 shows a circuit configuration of a voltage control oscillator 210 according to the present embodiment. The negative FET 20 is provided with a resonant circuit 52 and an amplifier circuit 54.

The resonant circuit 52 generates an oscillating signal having a frequency according to a control voltage Vcont supplied from a phase comparator, for example. The resonant circuit 52 passes resonance frequency components of the signal supplied from the amplifier circuit 54 and attenuates the other frequency components. Therefore, the resonant circuit 52 can generate the oscillating signal having a frequency according to the control voltage Vcont.

The amplifier circuit 54 amplifies the oscillating signal generated by the resonant circuit 52 and feeds the amplified signal back to the resonant circuit 52. Specifically, the amplifier circuit 54 performs positive feedback amplification on the oscillating signal generated by the resonant circuit 52 and supplies the resonant circuit 52 with the thusly amplified signal. In other words, the amplifier circuit 54 functions as a negative resistor connected to an input/output junction of the resonant circuit 52.

The resonant circuit 52 and the amplifier circuit 54 configured as described above can continue to output an oscillating signal having a frequency according to the control voltage Vcont. In other words, the resonant circuit 52 and the amplifier circuit 54 can perform an oscillating operation.

The resonant circuit 52 includes a positive resonance inductor 66, a negative resonance inductor 68, a positive resonance capacitor 70, a negative resonance capacitor 72, a positive variable capacitance diode 74, and a negative variable capacitance diode 76. The resonant circuit 52 outputs a noninverted oscillating signal from a first contact point 62. Furthermore, the resonant circuit 52 outputs an inverted oscillating signal from a second contact point 64.

The positive resonance inductor 66 is connected between the positive driving voltage $V_P$ and the first contact point 62. The negative resonance inductor 68 is connected between the positive driving voltage $V_P$ and the second contact point 64.

One end of the positive resonance capacitor 70 is connected to the first contact point 62 and the other end of the positive resonance capacitor 70 is connected to a cathode of the positive variable capacitance diode 74. One end of the negative resonance capacitor 72 is connected to the second contact point 64 and the other end of the positive resonance capacitor 70 is connected to a cathode of the negative variable capacitance diode 76. An anode of the positive variable capacitance diode 74 is connected to an anode of the negative variable capacitance diode 76.

The positive variable capacitance diode 74 and the negative variable capacitance diode 76 receive the control voltage Vcont supplied from the phase comparator at the anode-cathode junction. Capacitance of the positive variable capacitance diode 74 and the negative variable capacitance diode 76 is changed according to the control voltage Vcont received at the anode-cathode junction.

The resonant circuit 52 described above changes the resonance frequency of the impedance between the first contact point 62 and the second contact point 64 according to the supplied control voltage Vcont. Accordingly, the resonant circuit 52 can output a differential oscillating signal having a frequency according to the supplied control voltage Vcont.

The amplifier circuit 54 includes the constant current source apparatus 10, a positive capacitor 82, a negative capacitor 84, a first amplification transistor 86, a negative bias resistor 88, a second amplification transistor 90, and a positive bias resistor 92. The amplifier circuit 54 receives the noninverted oscillating signal from the first contact point 62, performs inverted amplification, and feeds the amplified signal back to the second contact point 64. Furthermore, the amplifier circuit 54 receives the inverted oscillating signal from the second contact point 64, performs inverted amplification, and feeds the amplified signal back to the first contact point 62.

The amplifier circuit 54 outputs the noninverted oscillating signal from a positive oscillating signal output end 94. Furthermore, the amplifier circuit 54 outputs the inverted oscillating signal from a negative oscillating signal output end 96.

Because the constant current source apparatus 10 has generally the same configuration and function as the constant current source apparatus 10 shown in FIG. 1, the following description includes only points of difference and omits identical points. The constant current source apparatus 10 causes a predetermined current Ic to flow to the negative driving voltage $V_M$. Specifically, the constant current source apparatus 10 sets the total value of the current flowing to the negative driving voltage $V_M$ from the first contact point 62 via the amplifier circuit 54 and the current flowing to the negative driving voltage $V_M$ from the second contact point 64 via the amplifier circuit 54 as the fixed value Ic.

The constant current source apparatus 10 receives from the external section a control signal instructing the voltage control oscillator 210 to perform oscillation or stop oscillation. In a case where a command signal instructing the voltage control oscillator 210 to perform oscillation is received from the external section, the constant current source apparatus 10 causes current to flow. In a case where a command signal instructing the voltage control oscillator 210 to stop oscillation is received from the external section, the constant current source apparatus 10 cuts off the current.

The positive capacitor 82 is serially connected between the first contact point 62 above the resonant circuit 52 and the positive oscillating signal output end 94. The positive capacitor 82 can cut off the continuous current flowing from the first contact point 62 to the positive oscillating signal output end 94.

The negative capacitor 84 is serially connected between the second contact point 64 above the resonant circuit 52 and the negative oscillating signal output end 96. The negative capacitor 84 can cut off the continuous current flowing from the second contact point 64 to the negative oscillating signal output end 96.

The first amplification transistor 86 receives at a base thereof the noninverted oscillating signal output from the first contact point 62 of the resonant circuit 52. The negative bias resistor 88 supplies a bias voltage to the base of the first amplification transistor 86. The first amplification transistor 86 then feeds back to the second contact point 64 of the resonant circuit 52 a current obtained by amplifying the received noninverted oscillating signal.

The first amplification transistor 86 may be an npn transistor, for example. In such a case, the base of the first amplification transistor 86 is connected to a wire between the positive oscillating signal output end 94 and the positive capacitor 82, a collector of the first amplification transistor 86 is connected to the second contact point 64, and an emitter of the first amplification transistor 86 is connected to the constant current source apparatus 10.

The first amplification transistor 86 described above functions as a switch connected between the second contact point 64 and the constant current source apparatus 10. In other words, the first amplification transistor 86 is on in a case where the voltage between the positive oscillating signal output end 94 and the positive capacitor 82 is greater than a prescribed voltage and is off in a case where the voltage between the positive oscillating signal output end 94 and the positive capacitor 82 is less than or equal to the prescribed voltage.

The second amplification transistor 90 receives at a base thereof the inverted oscillating signal output from the second contact point 64 of the resonant circuit 52. The positive bias resistor 92 supplies a bias voltage to the base of the second amplification transistor 90. The second amplification transistor 90 then feeds back to the first contact point 62 of the resonant circuit 52 a current obtained by amplifying the received inverted oscillating signal.

The second amplification transistor 90 may be an npn transistor, for example. In such a case, the base of the second amplification transistor 90 is connected to a wire between the negative oscillating signal output end 96 and the negative capacitor 84, a collector of the second amplification transistor 90 is connected to the first contact point 62, and an emitter of the second amplification transistor 90 is connected to the constant current source apparatus 10.

The second amplification transistor 90 described above functions as a switch connected between the first contact point 62 and the constant current source apparatus 10. In other words, the second amplification transistor 90 is on in a case where the voltage between the negative oscillating signal output end 96 and the negative capacitor 84 is greater than the prescribed voltage and is off in a case where the voltage between the negative oscillating signal output end 96 and the negative capacitor 84 is less than or equal to the prescribed voltage.

The amplifier circuit 54 described above can perform inverted amplification on the noninverted oscillating signal output from the first contact point 62 of the resonant circuit 52 and feed the amplified signal back to the second contact point 64 of the resonant circuit 52. In addition, the amplifier circuit 54 can perform inverted amplification on the inverted oscillating signal output from the second contact point 64 of the resonant circuit 52 and feed the amplified signal back to the first contact point 62 of the resonant circuit 52. Therefore, the resonant circuit 52 and the amplifier circuit 54 can perform positive feedback amplification on the differential oscillating signal having a prescribed frequency.

The voltage control oscillator 210 described above can output an oscillating signal in a case where a command signal instructing performance of oscillation is received from the external section because the constant current source apparatus 10 continuously causes the constant current to flow to perform the amplification operation on the oscillating signal. Furthermore, the voltage control oscillator 210 can stop oscillation in a case where a command signal instructing stoppage of oscillation is received from the external section because the constant current source apparatus 10 cuts off the flowing current to stop the amplification operation of the oscillating signal.

While the embodiment of the present invention has been described, the technical scope of the invention is not limited to the above described embodiment. It is apparent to persons skilled in the art that various alterations and improvements can be added to the above-described embodiment. It is also apparent from the scope of the claims that the embodiments added with such alterations or improvements can be included in the technical scope of the invention.

What is claimed is:

1. A constant current source apparatus, comprising:

a complementary switching section that selectively outputs a reference voltage or a driving voltage according to a control signal; and a constant current source circuit that causes a constant current determined by the reference voltage to flow to a load in a case where the reference voltage is received from the complementary switching section and cuts off the current flowing to the load in a case where the driving voltage is received from the complementary switching section, wherein the complementary switching section further includes:

a first FET in which one of either a source or a drain is connected to the driving voltage, the other source or drain is connected to an output end of the complementary switching section, and a gate receives the voltage according to the control signal;

a second FET that switches to an opposite polarity of the first FET, in which one of either a source or a drain is connected to the reference voltage, the other source or drain is connected to the output end of the complementary switching section, and a gate receives the voltage according to the control signal;

a bias section that supplies to a gate of the first FET and the second FET a first voltage that turns the first FET on and turns the second FET off or a second voltage that turns the first FET off and turns the second FET on; and a switching circuit that switches between supplying the first voltage to the gate of the first FET and the second FET and supplying the second voltage to the gate of the first FET and the second FET according to the control signal.

2. The constant current source apparatus according to claim 1, wherein the constant current source circuit includes a current mirror circuit that causes the current determined by the reference voltage received from the complementary switching section to flow to the load.

3. The constant current source apparatus according to claim 2, wherein the current mirror circuit includes:

a diode-connected control transistor; and a current source transistor that causes a current flowing to the load to flow to a collector-emitter junction thereof and in which a base thereof is connected to a base of the control transistor.

4. The constant current source apparatus according to claim 3, wherein the current mirror circuit further includes:

a first bias transistor that is connected between an emitter of the control transistor and the driving voltage and generates a bias determined by the reference voltage received from the complementary switching section; and a second bias transistor that is connected between an emitter of the current source transistor and the driving voltage and generates a bias determined by the reference voltage received from the complementary switching section.

5. The constant current source apparatus according to claim 4, wherein the first bias transistor and the second bias transistor become open in a case where the driving voltage is received from the complementary switching section.

6. The constant current source apparatus according to claim 1, wherein the complementary switching section further includes a protection resistor connected between an output end of the complementary switching section and the driving voltage.

7. The constant current source apparatus according to claim 1, further comprising a bandgap reference circuit that generates the reference voltage.

8. The constant current source apparatus according to claim 1, wherein the constant current source circuit is connected to an output end of the complementary switching section.

9. The constant current source apparatus according to claim 1, wherein the load is connected to the constant current source circuit.

10. The constant current source apparatus according to claim 1, wherein the reference voltage is received at the constant current source circuit from the complementary switching section via an output end of the complementary switching section.

11. The constant current source apparatus according to claim 1, wherein the driving voltage is received at the constant Current source circuit from the complementary switching section via an output end of the complementary switching section.

12. The constant current source apparatus according to claim 1, wherein the constant current source circuit, connected to an output end of the complementary switching section, causes the constant current determined by the reference voltage to flow to the load, connected to the constant current source circuit, in a case where the reference voltage is received from the complementary switching section via the output end, and cuts off the current flowing to the load in a case where the driving voltage is received from the complementary switching section via the output end.

13. The constant current source apparatus according to claim 1, wherein the control signal is supplied from an external section.

14. The constant current source apparatus according to claim 13, wherein the complementary switching section outputs the reference voltage in a case where the control signal indicating ON is supplied from the external section.

15. The constant current source apparatus according to claim 13, wherein the complementary switching section outputs the driving voltage in a case where the control signal indicating OFF is supplied from the external section.

16. A current control method comprising:

selectively outputting, by a complementary switching section, a reference voltage or a driving voltage according to a control signal, wherein the complementary switching section includes: a first FET in which one of either a source or a drain is connected to the driving voltage, the other source or drain is connected to an output end of the complementary switching section, and a gate receives the voltage according to the control signal; a second FET that switches to an opposite polarity of the first FET, in which one of either a source or a drain is connected to the reference voltage, the other source or drain is connected to the output end of the complementary switching section, and a gate receives the voltage according to the control signal; a bias section that supplies to a gate of the first FET and the second FET a first voltage that turns the first FET on and turns the second FET off or a second voltage that turns the first FET off and turns the second FET on; and a switching circuit that switches between supplying the first voltage to the gate of the first FET and the second FET and supplying the second voltage to the gate of the first FET and the second FET according to the control signal;

causing a constant current determined by the reference voltage to flow to a load in a case where the reference voltage is received from the complementary switching section; and cutting off the current flowing to the load in a case where the driving voltage is received from the complementary switching section.

* * * * *